US011368779B2

(12) United States Patent
Tseng et al.

(10) Patent No.: US 11,368,779 B2
(45) Date of Patent: Jun. 21, 2022

(54) HEADSET

(71) Applicant: Cheng Uei Precision Industry Co., LTD., New Taipei (TW)

(72) Inventors: Chi-Ming Tseng, New Taipei (TW); Chin-Chung Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/377,366

(22) Filed: Jul. 15, 2021

(65) Prior Publication Data

US 2022/0095028 A1 Mar. 24, 2022

(30) Foreign Application Priority Data

Sep. 24, 2020 (CN) ..... 202022131064.9

(51) Int. Cl.
*H04R 25/00* (2006.01)
*H04R 1/10* (2006.01)

(52) U.S. Cl.
CPC ..... *H04R 1/105* (2013.01)

(58) Field of Classification Search
CPC .... H04R 1/1033; H04R 1/105; H04R 1/1066; H04R 1/1008; H04R 5/033; H04R 1/1025; H04R 1/1041; H04R 1/1083; H04R 2201/103; H04R 2420/07
See application file for complete search history.

(56) References Cited

U.S. PATENT DOCUMENTS 9,723,392 B2 * 8/2017 Taylor ..... H04R 1/1066

* cited by examiner

*Primary Examiner* — Amir H Etesam
(74) *Attorney, Agent, or Firm* — Cheng-Ju Chiang

(57) ABSTRACT

A headset includes a curved headband, at least one sliding rod slidably arranged to one end of the headband, at least one suspension bracket rotatably connected to the at least one sliding rod, at least one insertion hole penetrating through the at least one suspension bracket, at least one fastening shaft mounted in the at least one insertion hole, and at least one elastic element. The at least one insertion hole has an assembling end, a buffering end, and a pivot block located between the assembling end and the buffering end. The at least one fastening shaft has a fixing portion, an extending portion, and an interfering portion located between the fixing portion and the extending portion. The pivot block clamps the interfering portion. The at least one elastic element is fastened between the extending portion and the buffering end.

20 Claims, 10 Drawing Sheets

HEADSET

CROSS-REFERENCE TO RELATED APPLICATION

The present application is based on, and claims priority from, China Patent Application No. 202022131064.9, filed Sep. 24, 2020, the disclosure of which is hereby incorporated by reference herein in its entirety.

BACKGROUND OF THE INVENTION

1. Field of the Invention

The present invention generally relates to a headset, and more particularly to a headset which is easy to be assembled and has a damping hand feeling at the time of two earphone monomers of the headset being rotated.

2. The Related Art

As is known to all, a conventional headset is one of the most commonly used electronic products. The conventional headset usually includes two earphone monomers, and a headband connected between the two earphone monomers. For the conventional headset, sound quality is one of the most important factors, and also a wearing experience is another one of the most important factors. In order to provide the comfortable wearing experience, the two earphone monomers are usually made to be rotatable for fitting two ears of a wearer better, and simultaneously, when each earphone monomer is rotated, a hand feeling effect of the wearer is hardly satisfied without a damping force effect.

Therefore, it is necessary and is especially important to provide a headset which is easy to be assembled and has a damping hand feeling at the time of two earphone monomers of the headset being rotated.

SUMMARY OF THE INVENTION

An object of the present invention is to provide a headset. The headset includes a curved headband, at least one sliding rod slidably arranged to one end of the headband and having at least one pivoting structure, at least one suspension bracket rotatably connected to the at least one pivoting structure of the at least one sliding rod, at least one insertion hole, at least one fastening shaft and at least one elastic element. The at least one sliding rod has two limitation blocks protruded outward from an outer portion and an inner portion of an outer surface of a periphery of the at least one pivoting structure of the at least one sliding rod. The at least one insertion hole is formed inside the at least one suspension bracket and penetrates through the at least one suspension bracket along an up-down direction. The at least one insertion hole is connected with the at least one pivoting structure. The at least one insertion hole has an assembling end receiving the at least one pivoting structure, a buffering end opposite to the assembling end, and a pivot block arranged around an inner wall of the at least one insertion hole and located between the assembling end and the buffering end. Two sides of an inner wall of the assembling end of the at least one insertion hole of the at least one suspension bracket are recessed oppositely to form two limitation slots. The two limitation blocks of the at least one sliding rod are slidably limited in the two limitation slots of the at least one suspension bracket. The at least one fastening shaft is mounted in the at least one insertion hole for making the at least one suspension bracket rotatably connected to the at least one pivoting structure of the at least one sliding rod. The at least one fastening shaft has a fixing portion configured for being connected with the at least one pivoting structure, an extending portion protruded upward from a middle of a top of the fixing portion, and an interfering portion disposed on an outer surface of the at least one fastening shaft, and the interfering portion is located between the fixing portion and the extending portion. The pivot block is cooperated with and clamps the interfering portion. The at least one elastic element is tightly fastened between the extending portion and the buffering end.

Another object of the present invention is to provide a headset. The headset includes a curved headband, two sliding rods, two suspension brackets, two insertion holes, two fastening shafts, two elastic elements and two earphone monomers. The two sliding rods are slidably disposed to distal ends of two opposite ends of the headband. A tail end of each sliding rod includes a pivoting structure. Each sliding rod has two limitation blocks protruded outward from an outer portion and an inner portion of an outer surface of a periphery of the pivoting structure of each sliding rod. The two suspension brackets are rotatably fastened to the two pivoting structures of the two sliding rods. The two insertion holes are formed inside the two suspension brackets and penetrate through the two suspension brackets along an up-down direction. The insertion hole of each suspension bracket is connected with one pivoting structure. The insertion hole of each suspension bracket has an assembling end receiving the one pivoting structure, a buffering end opposite to the assembling end, and a pivot block protruded inward from a middle of an inner wall of the insertion hole of each suspension bracket. The pivot block is located between the assembling end and the buffering end. Two sides of an inner wall of the assembling end of the insertion hole of each suspension bracket are recessed oppositely to form two limitation slots. The two limitation blocks of each pivoting structure are slidably limited in the two limitation slots of one suspension bracket. The two fastening shafts are mounted in the two insertion holes of the two suspension brackets and are fastened to the two pivoting structures of the two sliding rods. Each fastening shaft has a fixing portion arranged to be assembled with the pivoting structure of the one sliding rod, an extending portion protruded upward from a middle of a top of the fixing portion, and an interfering portion disposed on an outer surface of each fastening shaft, and arranged between the fixing portion and the extending portion. The two pivot blocks of the two suspension brackets are cooperated with and clamp the interfering portions of the two fastening shafts. The two elastic elements are tightly disposed between the two extending portions of the two fastening shafts and the two buffering ends of the two suspension brackets. The two earphone monomers are assembled to the two suspension brackets.

Another object of the present invention is to provide a headset. The headset includes a curved headband, two sliding rods slidably disposed to distal ends of two opposite ends of the headband, two suspension brackets, two fastening shafts, two elastic elements and two earphone monomers. A tail end of each sliding rod includes a pivoting structure. Each sliding rod has two limitation blocks protruded outward from an outer portion and an inner portion of an outer surface of a periphery of the pivoting structure of each sliding rod. The two suspension brackets are rotatably fastened to the two pivoting structures of the two sliding rods. A middle of each suspension bracket has an insertion hole which penetrates through each suspension bracket along an up-down direction. The insertion hole of each suspension bracket connected with one pivoting structure. The insertion hole of each suspension bracket has an assembling end receiving the one pivoting structure, a buffering end opposite to the assembling end, and a pivot block protruded inward from a middle of an inner wall of the insertion hole of each suspension bracket. The pivot block is located between the assembling end and the buffering end. Two sides of an inner wall of the assembling end of the insertion hole of each suspension bracket are recessed oppositely to form two limitation slots. The two limitation blocks of each sliding rod are slidably limited in the two limitation slots of one suspension bracket for limiting a rotating angle of each suspension bracket around the one sliding rod, so that when each suspension bracket rotates around the pivoting structure of the one sliding rod, each suspension bracket is stopped rotating until end walls of the two limitation slots of each suspension bracket block the two limitation blocks of the one sliding rod. The two fastening shafts are mounted in the two insertion holes of the two suspension brackets and fastened to the two pivoting structures of the two sliding rods. Each fastening shaft has a fixing portion arranged to be assembled with the pivoting structure of the one sliding rod, an extending portion protruded upward from a middle of a top of the fixing portion, and an interfering portion disposed on an outer surface of each fastening shaft, and arranged between the fixing portion and the extending portion. The interfering portions of the two fastening shafts are interfered with the two pivot blocks of the two suspension brackets. The two elastic elements are tightly disposed between the two extending portions of the two fastening shafts and the two buffering ends of the two suspension brackets. The two earphone monomers are assembled to the two suspension brackets.

As described above, when the headset is assembled, the two elastic elements are assembled in two limiting slots or at least two restricting slots of the two fastening shafts, and when the two hollow fastening shafts are inserted into the insertion holes of the two suspension brackets, the two elastic elements that are mounted around and slightly protruded beyond the outer periphery surfaces of the two extending portions will be tightly cooperated with and will be interfered with the inner walls of the two insertion holes of the two buffering ends of the two suspension brackets, so the headset is easy to be assembled and has a damping hand feeling at the time of the two earphone monomers of the headset being rotated.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
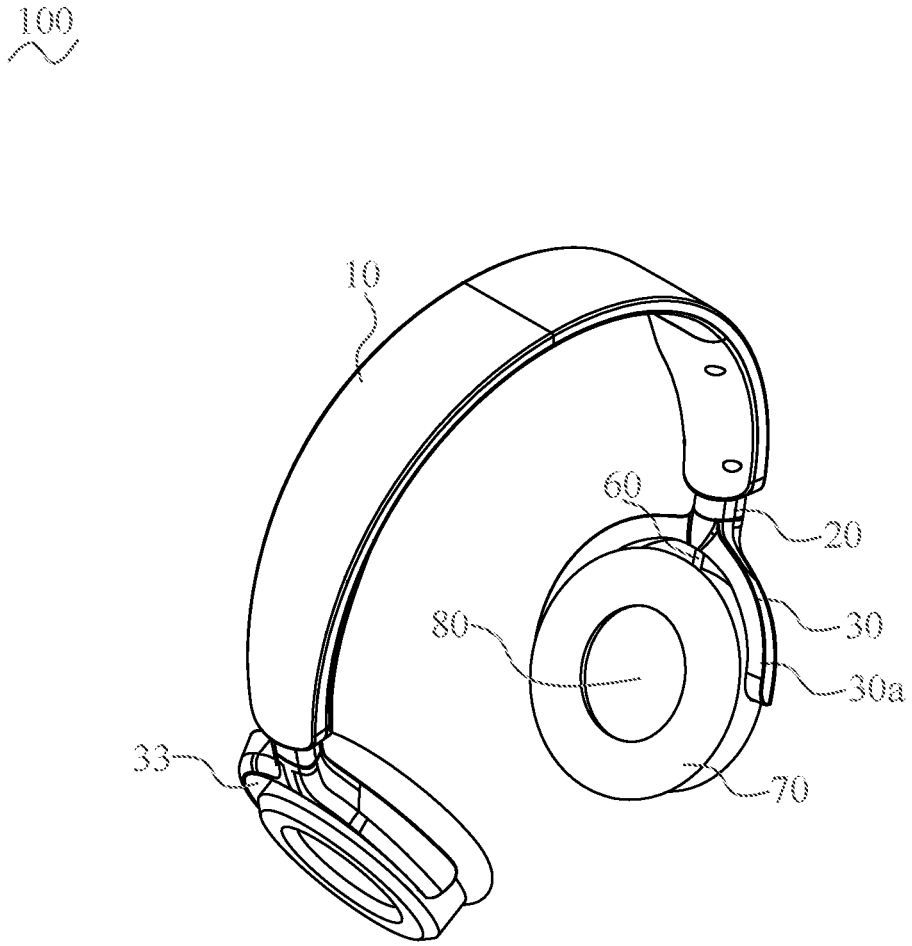
FIG. 1 is a perspective view of a headset in accordance with the present invention.
Figure 2:
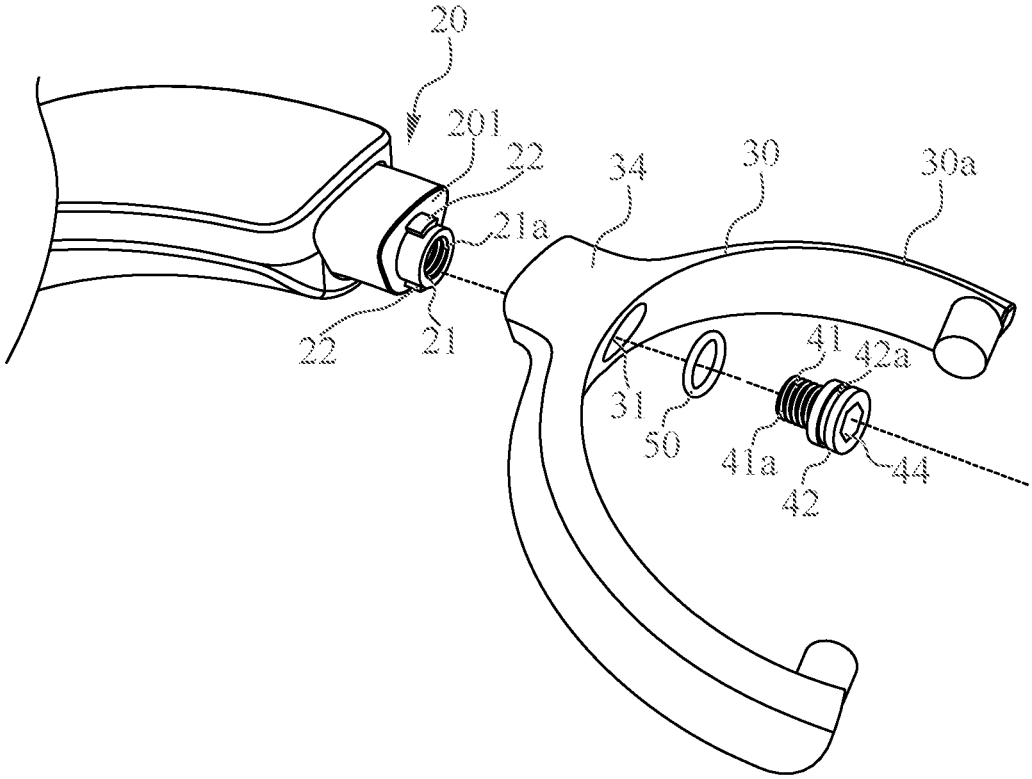
FIG. 2 is a partially exploded view of the headset in accordance with the present invention.
Figure 3:
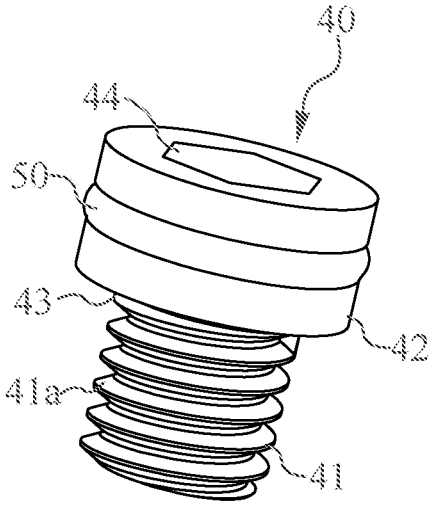
FIG. 3 is a perspective view showing that a fastening shaft of the headset is assembled with an elastic element of the headset in accordance with the present invention.
Figure 4:
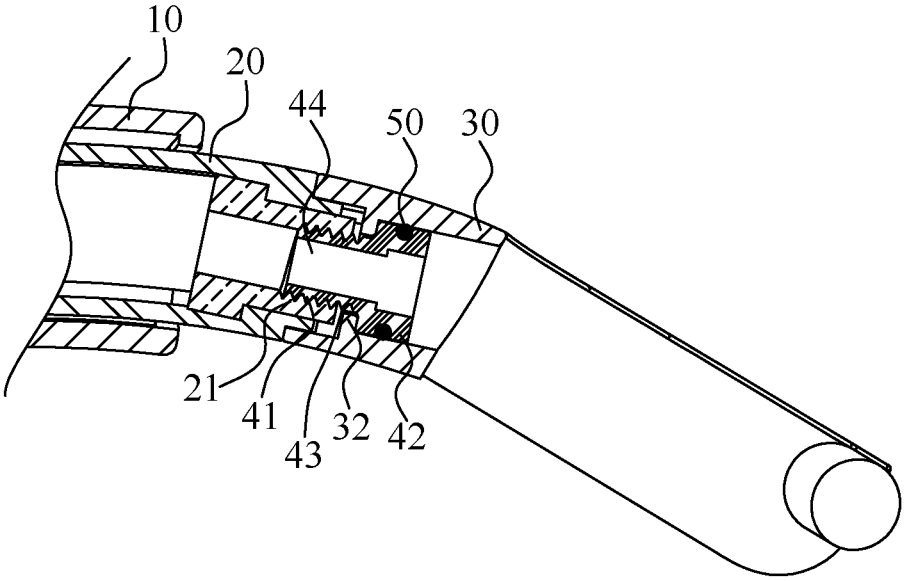
FIG. 4 is a sectional view of one end of the headset in accordance with the present invention.
Figure 5:
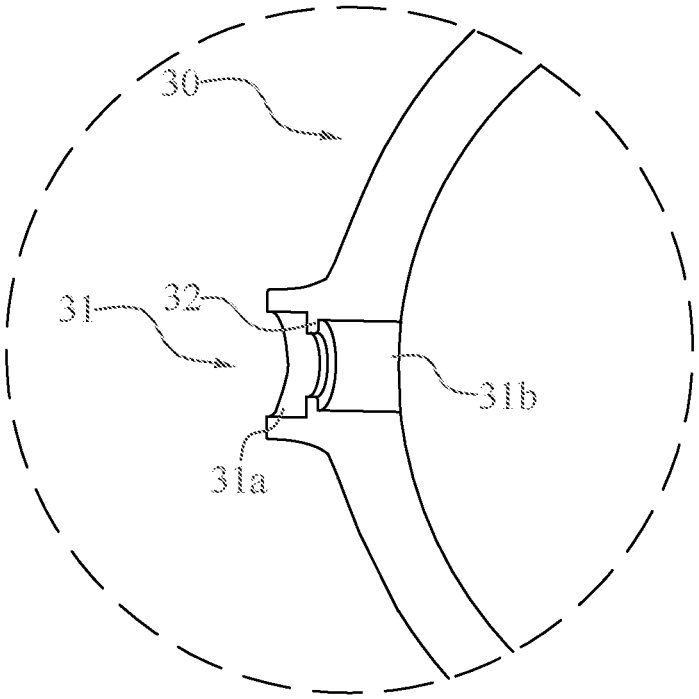
FIG. 5 is a partially sectional view of the headset showing a suspension bracket of the headset in accordance with the present invention.
Figure 6:
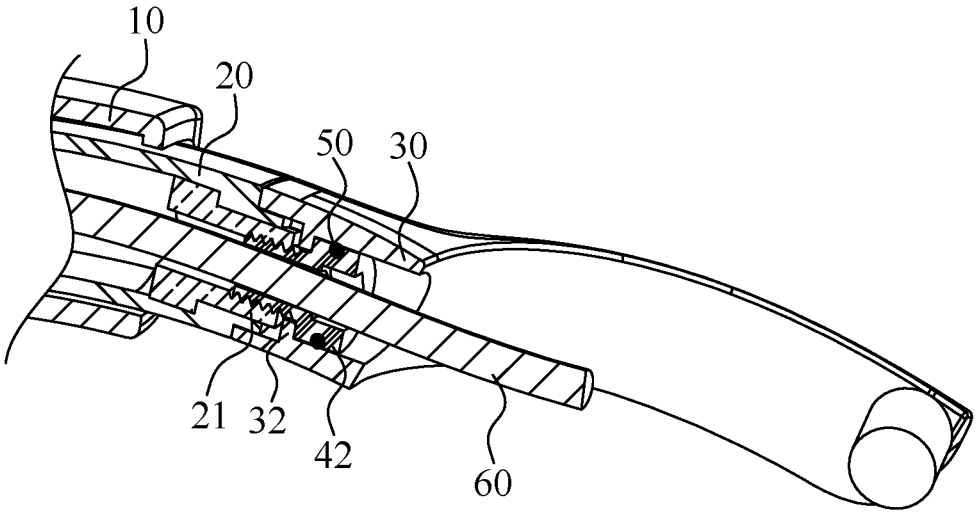
FIG. 6 is another partially sectional view of the headset, wherein the one end of the headset is equipped with a cable in accordance with the present invention.
Figure 7:
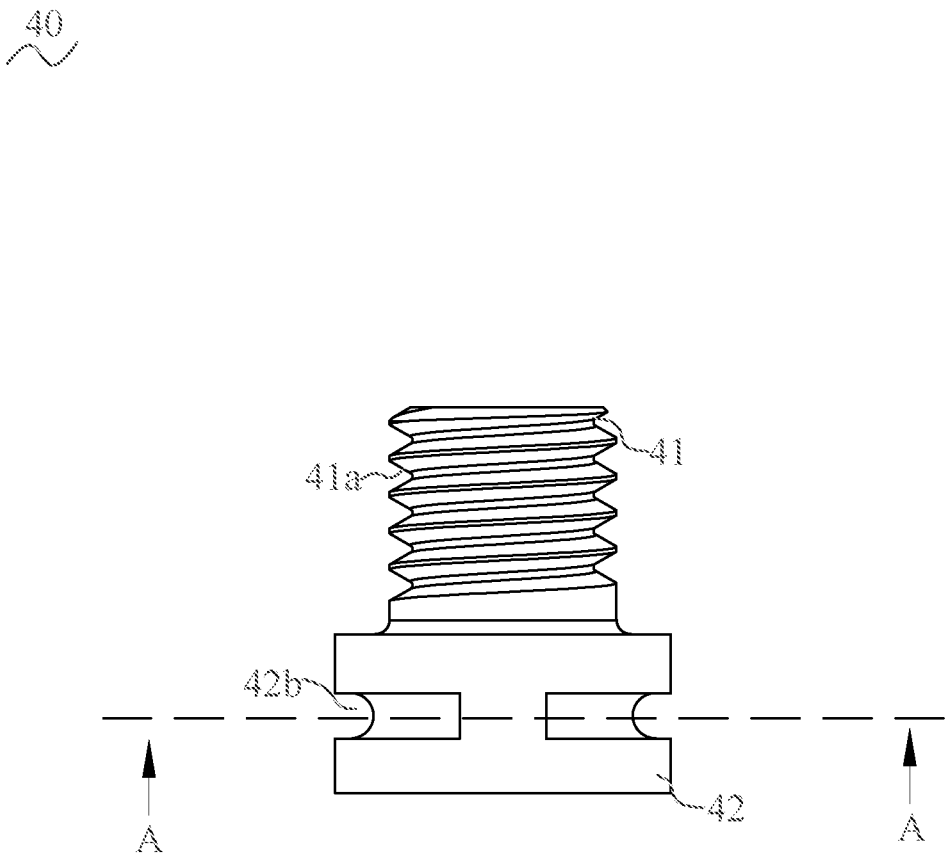
FIG. 7 is a front view of the fastening shaft of the headset in accordance with another embodiment of the present invention.
Figure 8:
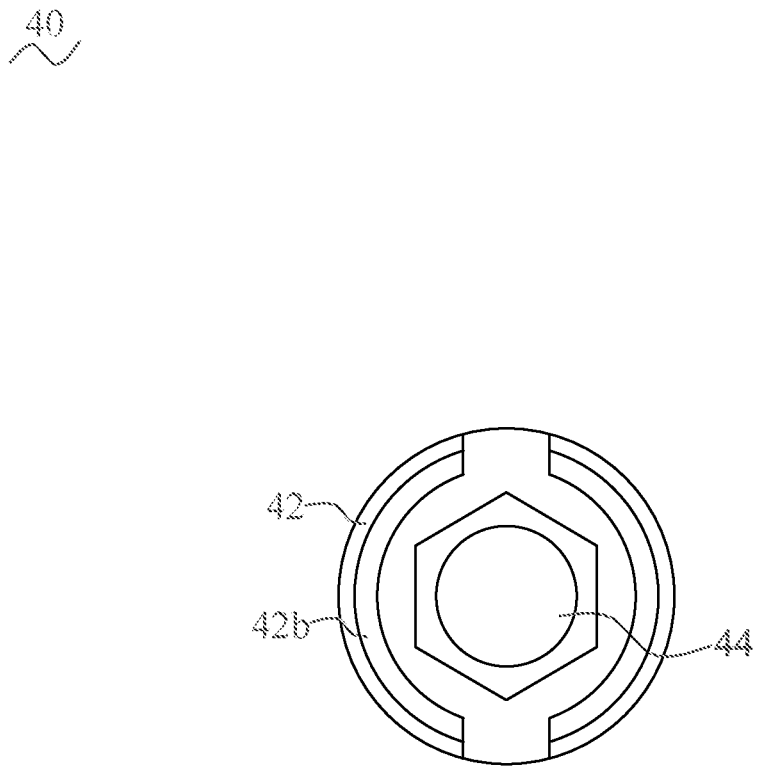
FIG. 8 is a sectional view of the fastening shaft of the headset along a line A-A of FIG. 7.
Figure 9:
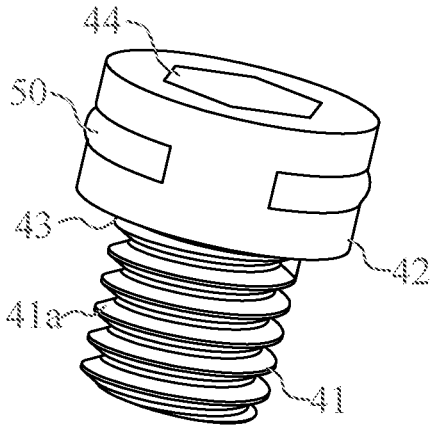
FIG. 9 is a partially assembling view showing that the fastening shaft is assembled with the elastic element of the headset of FIG. 7.
Figure 10:
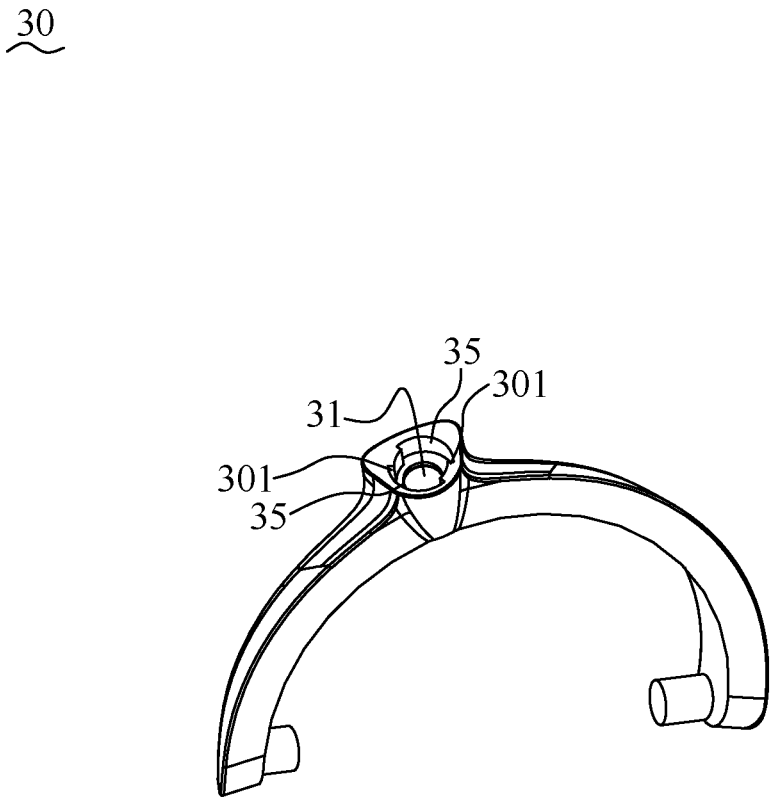
FIG. 10 is a perspective view of the suspension bracket of the headset in accordance with the present invention.

Referring to FIG. 1 to FIG. 3, a headset 100 in accordance with a preferred embodiment of the present invention is show. In this present invention, the headset 100 includes a curved headband 10, at least one sliding rod 20, at least one suspension bracket 30, at least one fastening shaft 40, at least one elastic element 50, at least one earmuff 70, and at least one earphone monomer 80. In the preferred embodiment, the headset 100 includes two sliding rods 20 slidably arranged to two opposite ends of the headband 10, two suspension brackets 30, two earmuffs 70 and two earphone monomers 80.

Referring to FIG. 1 to FIG. 5, the at least one sliding rod 20 is slidably arranged to one end of the headband 10 and has at least one pivoting structure 21. The at least one pivoting structure 21 is shown as a hollow cylinder shape. An inside of the at least one pivoting structure 21 has an internal thread structure 21*a*. The at least one suspension bracket 30 is rotatably connected to a tail end 201 of the at least one sliding rod 20. The at least one suspension bracket 30 is rotatably connected to the at least one pivoting structure 21 of the at least one sliding rod 20. A middle of the at least one suspension bracket 30 has at least one insertion hole 31 formed inside the at least one suspension bracket 30 and penetrating through the at least one suspension bracket 30 along an up-down direction. The at least one insertion hole 31 is cylindrical and is matched with the at least one pivoting structure 21. The at least one insertion hole 31 is connected with the at least one pivoting structure 21. The at least one insertion hole 31 is connected with the at least one sliding rod 20, and the at least one insertion hole 31 has an assembling end 31*a* positioned next to the at least one sliding rod 20 and receiving the at least one pivoting structure 21, a buffering end 31*b* opposite to the assembling end 31*a*, and a pivot block 32 located between the assembling end 31*a* and the buffering end 31*b*. The pivot block 32 is arranged around an inner wall of the at least one insertion hole 31.

The at least one fastening shaft 40 is mounted in the at least one insertion hole 31 for making the at least one suspension bracket 30 rotatably connected to the at least one pivoting structure 21 of the tail end 201 of the at least one sliding rod 20. The at least one fastening shaft 40 is assembled with the at least one sliding rod 20, and the at least one fastening shaft 40 has a fixing portion 41 configured for being connected with the at least one pivoting structure 21, an extending portion 42 protruded upward from a middle of a top of the fixing portion 41, and an interfering portion 43 disposed on an outer surface of the at least one fastening shaft 40, and the interfering portion 43 is located between the fixing portion 41 and the extending portion 42.

An outer surface of the fixing portion 41 of the at least one fastening shaft 40 has an external thread structure 41*a*. The external thread structure 41*a* is engaged with the internal thread structure 21*a* to make the external thread structure 41*a* connected with and fastened with the internal thread structure 21*a*. The pivot block 32 is cooperated with and clamps the interfering portion 43, and a bottom surface of the pivot block 32 is blocked by a periphery of a top surface of the extending portion 42. A middle of an outer periphery surface of the extending portion 42 of the at least one fastening shaft 40 is recessed inward to form at least one annular limiting slot 42*a*. The at least one fastening shaft 40 defines a penetrating hole 44 penetrating through middles of a top surface and a bottom surface of the at least one fastening shaft 40. An inside of the at least one pivoting structure 21 of the at least one sliding rod 20 is communicated with the at least one insertion hole 31 through the penetrating hole 44 of the at least one fastening shaft 40.

The at least one elastic element 50 is tightly fastened between the extending portion 42 and the buffering end 31*b*. The at least one elastic element 50 is an annular gasket, and the at least one elastic element 50 is assembled in and limited in the at least one limiting slot 42*a* of the at least one fastening shaft 40. An outer periphery of the at least one elastic element 50 projects beyond the outer periphery surface of the extending portion 42 of the at least one fastening shaft 40. A shore hardness of the at least one elastic element 50 is more than A50 and is less than A70.

The two sliding rods 20 are slidably disposed to distal ends of two opposite ends of the headband 10. The tail end 201 of each sliding rod 20 includes a pivoting structure 21. The pivoting structure 21 of each sliding rod 20 is shown as the hollow cylinder shape. The two pivoting structures 21 are arranged to two tail ends 201 of the two sliding rods 20. Middles of bottom surfaces of the two sliding rods 20 protrude downward and towards each other to form the two pivoting structures 21.

Each suspension bracket 30 has a base portion 34, and a fastening structure 30*a* positioned at one end of the base portion 34. The two base portions 34 of the two suspension brackets 30 are connected with the two pivoting structures 21 of the two sliding rods 20. The two tail ends 201 of the two sliding rods 20 are connected with the two suspension brackets 30. The two fastening structures 30*a* are connected with the two tail ends 201 of the two sliding rods 20 by the two pivoting structures 21 and the two base portions 34. The two fastening structures 30*a* extend downward and inward, and the two fastening structures 30*a* extend towards each other. Two opposite sides of the base portion 34 of one suspension bracket 30 extend downward and inward towards the other suspension bracket 30, and are bent oppositely to form one fastening structure 30*a*. Two opposite sides of the base portion 34 of the other suspension bracket 30 extend downward and inward towards the one suspension bracket 30, and are bent oppositely to form the other fastening structure 30*a*. Preferably, two opposite sides of each fastening structure 30*a* are symmetrical to each other with respect to the base portion 34 of each fastening structure 30*a*. Each fastening structure 30*a* is shown as a C shape. A mouth 33 of each C-shaped fastening structure 30*a* faces downward. The two suspension brackets 30 are rotatably fastened to the two pivoting structures 21 of the two tail ends 201 of the two sliding rods 20.

The two earphone monomers 80 are assembled to the two suspension brackets 30. The two earphone monomers 80 are mounted in the two earmuffs 70. The two earmuffs 70 with the two earphone monomers 80 are assembled in the two mouths 33 of the two suspension brackets 30. The two earmuffs 70 and the two earphone monomers 80 are suspended to lower surfaces of the two suspension brackets 30. The two earmuffs 70 and the two earphone monomers 80 are suspended to inner surfaces of the two fastening structures 30*a* of the two suspension brackets 30, respectively for fitting with two ears of a wearer. The two fastening structures 30*a* surround upper portions of two peripheries of the two earmuffs 70 with the two earphone monomers 80. The two earmuffs 70 with the two earphone monomers 80 are tightly attached to the two ears of the wearer.

Referring to FIG. 1 to FIG. 5, in order to make the two suspension brackets 30 rotatably connected to the two tail ends 201 of the two sliding rods 20, a middle of each suspension bracket 30 has an insertion hole 31 which penetrates through each suspension bracket 30 along the up-down direction. The insertion hole 31 of each suspension bracket 30 is cylindrical and is matched with the pivoting structure 21. Two insertion holes 31 of the two suspension brackets 30 are formed inside the two suspension brackets 30 and penetrate through the two suspension brackets 30 along the up-down direction. A middle of the base portion 34 defines the insertion hole 31 penetrating through the base portion 34 along the up-down direction. The insertion hole 31 and the mouth 33 of each suspension bracket 30 are communicated with each other. The insertion hole 31 of each suspension bracket 30 is equipped with a hollow fastening shaft 40. The two fastening shafts 40 are mounted in the two insertion holes 31 of the two suspension brackets 30 and are fastened to the two pivoting structures 21 of the two sliding rods 20.

In detail, the insertion hole 31 of each suspension bracket 30 is connected with one pivoting structure 21 of one sliding rod 20, and the insertion hole 31 of each suspension bracket 30 has the assembling end 31*a* positioned next to the one sliding rod 20 and receiving the one pivoting structure 21, the buffering end 31*b* opposite to the assembling end 31*a* and positioned away from the one sliding rod 20, and the pivot block 32. The pivot block 32 is located between the assembling end 31*a* and the buffering end 31*b*. The pivot block 32 is protruded inward from a middle of an inner wall of the insertion hole 31 of each suspension bracket 30. The pivot block 32 is shown as a ring shape. The assembling end 31*a* and the buffering end 31*b* are communicated with each other by a middle of the pivot block 32.

Each hollow fastening shaft 40 has the fixing portion 41 arranged to be pivotally assembled with the pivoting structure 21 of the one sliding rod 20, the extending portion 42 protruded downward and expanded outward from a middle of a bottom of the fixing portion 41, and the interfering portion 43 disposed on an outer surface of each fastening shaft 40, and arranged between the fixing portion 41 and the extending portion 42. The fixing portion 41 is protruded upward from a middle of a top surface of the extending portion 42. The interfering portion 43 and the extending portion 42 of each fastening shaft 40 are adjacent to each other. The interfering portions 43 of the two fastening shafts 40 are interfered with the two pivot blocks 32 of the two suspension brackets 30 for ensuring that each suspension bracket 30 is next to the one sliding rod 20. The two pivot blocks 32 of the two suspension brackets 30 are cooperated with and clamp the interfering portions 43 of the two fastening shafts 40, and bottom surfaces of the two pivot blocks 32 of the two suspension brackets 30 are blocked by the peripheries of the top surfaces of the two extending portions 42 of the two fastening shafts 40.

An inside of the pivoting structure 21 of each sliding rod 20 has the internal thread structure 21*a*. The outer surface of the fixing portion 41 of each fastening shaft 40 assembled with the one sliding rod 20 has the external thread structure 41*a*. The external thread structures 41*a* of the two fastening shafts 40 are engaged with the internal thread structures 21*a* of the two sliding rods 20 for making the external thread structures 41*a* of the two fastening shafts 40 cooperated with and connected with the internal thread structures 21*a* of the two sliding rods 20 to keep the two suspension brackets 30 connected with the two tail ends 201 of the two sliding rods 20. The two pivot blocks 32 of the two suspension brackets 30 are configured for clamping and being buckled with the two interfering portions 43 of the two fastening shafts 40, so the two suspension brackets 30 are rotatably fastened with the two hollow fastening shafts 40.

Referring to FIG. 1 to FIG. 9, when the headset 100 is assembled, the two pivot blocks 32 of the two suspension brackets 30 are configured to be buckled to the two interfering portions 43 of the two fastening shafts 40 to make the two suspension brackets 30 rotatably fastened to outer surfaces of the two fastening shafts 40. Then the two suspension brackets 30 are rotatably fastened to the two tail ends 201 of the two sliding rods 20 by virtue of the two fixing portions 41 of the two fastening shafts 40 being pivotally connected to and fastened to the two pivoting structures 21 of the two sliding rods 20.

Referring to FIG. 1 to FIG. 9 again, in order to reach an effect of the headset 100 being easy to be assembled and satisfy a damping hand feeling at the time of the wearer rotating the two earmuffs 70 with the two earphone monomers 80, the headset 100 further includes two elastic elements 50. The two elastic elements 50 are tightly and elastically disposed between the two extending portions 42 of the two fastening shafts 40 and the two buffering ends 31*b* of the two suspension brackets 30. In the preferred embodiment, the two extending portions 42 are integrally molded and formed at bottom ends of the two hollow fastening shafts 40. The extending portion 42 of each fastening shaft 40 is defined as a cylinder shape. A middle of the outer periphery surface of the extending portion 42 of each fastening shaft 40 is recessed inward to form an annular limiting slot 42*a*. Each elastic element 50 is the annular gasket, and the two elastic elements 50 are assembled in and limited in the two limiting slots 42*a* of the two fastening shafts 40. The two elastic elements 50 are mounted around the two extending portions 42 of the two fastening shafts 40, and outer peripheries of the two elastic elements 50 are slightly protruded beyond the two outer periphery surfaces of the two extending portions 42 of the two fastening shafts 40. The two fastening shafts 40 together with the two elastic elements 50 are received in the two buffering ends 31*b* of the two suspension brackets 30. The two fastening shafts 40 together with the two elastic elements 50 are tightly fitted between and limited between the two extending portions 42 of the two fastening shafts 40 and the two buffering ends 31*b* of the two suspension brackets 30. A shore hardness of each elastic element 50 is more than A50 and is less than A70.

Therefore, when the headset 100 is assembled, the two elastic elements 50 are assembled in the two limiting slots 42*a* of the two fastening shafts 40. When the two hollow fastening shafts 40 are inserted into the insertion holes 31 of the two suspension brackets 30, the two elastic elements 50 that are mounted around and slightly protruded beyond the outer periphery surfaces of the two extending portions 42 will be tightly cooperated with and will be interfered with inner walls of the two buffering ends 31*b* of the two insertion holes 31 of the two suspension brackets 30, and thus a relative damping force and a damping hand feeling are generated at the time of the two suspension brackets 30 and the two earphone monomers 80 of the headset 100 being rotated under an external force.

Referring to FIG. 5 to FIG. 9, in another preferred embodiment, at least two portions of the two outer periphery surfaces of the two extending portions 42 of the two fastening shafts 40 are recessed inward to form at least two restricting slots 42*b*. The extending portion 42 of each fastening shaft 40 has two restricting slots 42*b*. The two restricting slots 42*b* are symmetrically formed at the outer periphery surface of the extending portion 42 of each fastening shaft 40. The two extending portions 42 are integrally molded and formed at the bottom ends of the two hollow fastening shafts 40. The two extending portions 42 of the two fastening shafts 40 are defined as the cylinder shapes. The two extending portions 42 of the two fastening shafts 40 protrude beyond the two outer surfaces of the two hollow fastening shafts 40. The two elastic elements 50 are abrasion resistant rubbers and are molded into and fastened in the at least two restricting slots 42*b* of the two fastening shafts 40 by an injection molding technology. The two elastic elements 50 are slightly protruded from and further protruded beyond the two outer periphery surfaces of the two extending portions 42 of the two fastening shafts 40 and are tightly cooperated with the buffering ends 31*b* of the two suspension brackets 30.

Referring to FIG. 1 to FIG. 6, in order to make the headset 100 further include at least one cable 60 connected between the headband 10 and the two earphone monomers 80, and when the two suspension brackets 30 are rotated, the at least one cable 60 of the headset 100 is without causing a torsion phenomenon or a winding phenomenon to affect a normal usage of the headset 100, each fastening shaft 40 defines the penetrating hole 44 penetrating through middles of a top surface and a bottom surface of each fastening shaft 40. The penetrating hole 44 of each fastening shaft 40 penetrates through the fixing portion 41 and the extending portion 42 of each fastening shaft 40 along the up-down direction. The insides of the two pivoting structures 21 of the two sliding rods 20 are communicated with the two insertion holes 31 of the two buffering ends 31*b* of the two suspension brackets 30 through the two penetrating holes 44 of the two fastening shafts 40. The at least one cable 60 passes through the two penetrating holes 44 of the two fastening shafts 40, and the at least one cable 60 is exposed out of the two insertion holes 31 of the two suspension brackets 30 and is connected with the two earphone monomers 80.

Referring to FIG. 1 to FIG. 10, the at least one sliding rod 20 has two limitation blocks 22. The two limitation blocks 22 are further arranged at an outer portion and an inner portion of the tail end 201 of the at least one sliding rod 20. The two limitation blocks 22 of the at least one sliding rod 20 are protruded outward from an outer portion and an inner portion of an outer surface of a periphery of the at least one pivoting structure 21 of the at least one sliding rod 20. Two sides of an inner wall of the assembling end 31*a* of the at least one insertion hole 31 of the at least one suspension bracket 30 are recessed oppositely to form two limitation slots 35 for limiting a rotating angle of the at least one suspension bracket 30. The two limitation blocks 22 of the at least one sliding rod 20 and the two limitation slots 35 of the at least one suspension bracket 30 are arc shapes.

When the at least one pivoting structure 21 of the tail end 201 of the at least one sliding rod 20 is assembled to the at least one suspension bracket 30, the at least one pivoting structure 21 of the at least one sliding rod 20 is inserted into the at least one insertion hole 31 of the at least one suspension bracket 30, the two limitation blocks 22 of the at least one sliding rod 20 are slidably limited in the two limitation slots 35 of the at least one suspension bracket 30 for limiting a rotating angle of the at least one suspension bracket 30 around the at least one sliding rod 20, and the two limitation blocks 22 of the at least one sliding rod 20 are slidable along the two limitation slots 35 of the at least one suspension bracket 30, so that when the at least one suspension bracket 30 rotates around the at least one pivoting structure 21 of the tail end 201 of the at least one sliding rod 20, the at least one suspension bracket 30 is stopped rotating until end walls 301 of the two limitation slots 35 of the at least one suspension bracket 30 block the two limitation blocks 22 of the at least one sliding rod 20. The at least one suspension bracket 30 is rotated towards a clockwise direction or an anticlockwise direction.

When the at least one suspension bracket 30 is rotated in place, the end walls 301 of the two limitation slots 35 of the at least one suspension bracket 30 reach the two limitation blocks 22 of the at least one sliding rod 20 and the end walls 301 of the two limitation slots 35 of the at least one suspension bracket 30 block the two limitation blocks 22 of the at least one sliding rod 20, so that the at least one suspension bracket 30 is prevented from being overly rotated around the at least one sliding rod 20. In the present invention, the at least one pivoting structure 21 is inserted into and is molded into the tail end 201 of the at least one sliding rod 20, and in the at least one sliding rod 20, the at least one pivoting structure 21 is located between the two limitation blocks 22.

Referring to FIG. 1 to FIG. 10 again, each sliding rod 20 has the two limitation blocks 22. The two limitation blocks 22 are further arranged at an outer portion and an inner portion of the tail end 201 of each sliding rod 20. The two limitation blocks 22 are protruded outward from an outer portion and an inner portion of an outer surface of a periphery of the pivoting structure 21 of each sliding rod 20. Two sides of the inner wall of the assembling end 31*a* of the insertion hole 31 of each suspension bracket 30 are recessed oppositely to form the two limitation slots 35 for limiting a rotating angle of each suspension bracket 30. The two limitation blocks 22 of each sliding rod 20 and the two limitation slots 35 of each suspension bracket 30 are the arc shapes.

When the pivoting structure 21 of the tail end 201 of each sliding rod 20 is assembled to the one suspension bracket 30, the pivoting structure 21 of each sliding rod 20 is inserted into the insertion hole 31 of the one suspension bracket 30, the two limitation blocks 22 of each pivoting structure 21 are slidably limited in the two limitation slots 35 of the one suspension bracket 30 for limiting the rotating angle of each suspension bracket 30 around the one sliding rod 20, and the two limitation blocks 22 of each sliding rod 20 are slidable along the two limitation slots 35 of the one suspension bracket 30, so that when each suspension bracket 30 rotates around the pivoting structure 21 of the tail end 201 of the one sliding rod 20, each suspension bracket 30 is stopped rotating until end walls 301 of the two limitation slots 35 of each suspension bracket 30 block the two limitation blocks 22 of the one sliding rod 20. Each suspension bracket 30 is rotated towards the clockwise direction or the anticlockwise direction.

When each suspension bracket 30 is rotated in place, the end walls 301 of the two limitation slots 35 of each suspension bracket 30 reach the two limitation blocks 22 of the one sliding rod 20 and the end walls 301 of the two limitation slots 35 of each suspension bracket 30 block the two limitation blocks 22 of the one sliding rod 20, so that each suspension bracket 30 is prevented from being overly rotated around the one sliding rod 20. In the present invention, the pivoting structure 21 is inserted into and is molded into the tail end 201 of each sliding rod 20, and in each sliding rod 20, the pivoting structure 21 is located between the two limitation blocks 22.

As described above, when the headset 100 is assembled, the two elastic elements 50 are assembled in the two limiting slots 42*a* or the at least two restricting slots 42*b* of the two fastening shafts 40, and when the two hollow fastening shafts 40 are inserted into the insertion holes 31 of the two suspension brackets 30, the two elastic elements 50 that are mounted around and slightly protruded beyond the outer periphery surfaces of the two extending portions 42 will be tightly cooperated with and will be interfered with the inner walls of the two insertion holes 31 of the two buffering ends 31*b* of the two suspension brackets 30, so the headset 100 is easy to be assembled and has the damping hand feeling at the time of the two earphone monomers 80 of the headset 100 being rotated.

What is claimed is:

1. A headset, comprising:

a curved headband;

at least one sliding rod slidably arranged to one end of the headband and having at least one pivoting structure, the at least one sliding rod having two limitation blocks protruded outward from an outer portion and an inner portion of an outer surface of a periphery of the at least one pivoting structure of the at least one sliding rod;

at least one suspension bracket rotatably connected to the at least one pivoting structure of the at least one sliding rod;

at least one insertion hole formed inside the at least one suspension bracket and penetrating through the at least one suspension bracket along an up-down direction, the at least one insertion hole connected with the at least one pivoting structure of the at least one sliding rod, the at least one insertion hole having an assembling end receiving the at least one pivoting structure, a buffering end opposite to the assembling end, and a pivot block arranged around an inner wall of the at least one insertion hole and located between the assembling end and the buffering end, two sides of an inner wall of the assembling end of the at least one insertion hole of the at least one suspension bracket being recessed oppositely to form two limitation slots, the two limitation blocks of the at least one sliding rod being slidably limited in the two limitation slots of the at least one suspension bracket;

at least one fastening shaft mounted in the at least one insertion hole for making the at least one suspension bracket rotatably connected to the at least one pivoting structure of the at least one sliding rod, the at least one fastening shaft having a fixing portion configured for being connected with the at least one pivoting structure, an extending portion protruded upward from a middle of a top of the fixing portion, and an interfering portion disposed on an outer surface of the at least one fastening shaft, and the interfering portion being located between the fixing portion and the extending portion, the pivot block being cooperated with and clamping the interfering portion; and at least one elastic element tightly fastened between the extending portion and the buffering end.

2. The headset as claimed in claim 1, wherein a middle of an outer periphery surface of the extending portion of the at least one fastening shaft is recessed inward to form at least one annular limiting slot, the at least one elastic element is an annular gasket, and the at least one elastic element is assembled in and limited in the at least one limiting slot, an outer periphery of the at least one elastic element projects beyond the outer periphery surface of the extending portion of the at least one fastening shaft.

3. The headset as claimed in claim 1, wherein an inside of the at least one pivoting structure has an internal thread structure, an outer surface of the fixing portion of the at least one fastening shaft has an external thread structure, the external thread structure is engaged with the internal thread structure to make the external thread structure connected with and fastened with the internal thread structure.

4. The headset as claimed in claim 1, wherein the at least one fastening shaft defines a penetrating hole penetrating through middles of a top surface and a bottom surface of the at least one fastening shaft, an inside of the at least one pivoting structure of the at least one sliding rod is communicated with the at least one insertion hole through the penetrating hole of the at least one fastening shaft.

5. The headset as claimed in claim 1, wherein the pivot block is shown as a ring shape.

6. The headset as claimed in claim 1, wherein a shore hardness of the at least one elastic element is more than A50 and is less than A70.

7. The headset as claimed in claim 1, wherein the at least one pivoting structure is shown as a hollow cylinder shape, the at least one insertion hole is cylindrical and is matched with the at least one pivoting structure, the two limitation blocks of the at least one sliding rod and the two limitation slots of the at least one suspension bracket are arc shapes.

8. A headset, comprising:

a curved headband;

two sliding rods slidably disposed to distal ends of two opposite ends of the headband, a tail end of each sliding rod including a pivoting structure, each sliding rod having two limitation blocks protruded outward from an outer portion and an inner portion of an outer surface of a periphery of the pivoting structure of each sliding rod;

two suspension brackets rotatably fastened to the two pivoting structures of the two sliding rods;

two insertion holes formed inside the two suspension brackets and penetrating through the two suspension brackets along an up-down direction, the insertion hole of each suspension bracket connected with one pivoting structure, the insertion hole of each suspension bracket having an assembling end receiving the one pivoting structure, a buffering end opposite to the assembling end, and a pivot block protruded inward from a middle of an inner wall of the insertion hole of each suspension bracket, the pivot block being located between the assembling end and the buffering end, two sides of an inner wall of the assembling end of the insertion hole of each suspension bracket being recessed oppositely to form two limitation slots, the two limitation blocks of each pivoting structure being slidably limited in the two limitation slots of one suspension bracket;

two fastening shafts mounted in the two insertion holes of the two suspension brackets and fastened to the two pivoting structures of the two sliding rods, each fastening shaft having a fixing portion arranged to be assembled with the pivoting structure of the one sliding rod, an extending portion protruded upward from a middle of a top of the fixing portion, and an interfering portion disposed on an outer surface of each fastening shaft, and arranged between the fixing portion and the extending portion, the two pivot blocks of the two suspension brackets being cooperated with and clamping the interfering portions of the two fastening shafts;

two elastic elements tightly disposed between the two extending portions of the two fastening shafts and the two buffering ends of the two suspension brackets; and two earphone monomers assembled to the two suspension brackets.

9. The headset as claimed in claim 8, wherein bottom surfaces of the two pivot blocks of the two suspension brackets are blocked by peripheries of top surfaces of the two extending portions of the two fastening shafts.

10. The headset as claimed in claim 8, wherein a middle of an outer periphery surface of the extending portion of each fastening shaft is recessed inward to form an annular limiting slot, each elastic element is an annular gasket, and the two elastic elements are limited in the two limiting slots of the two fastening shafts, the two elastic elements are mounted around and slightly protruded beyond the two outer periphery surfaces of the two extending portions.

11. The headset as claimed in claim 8, wherein an inside of the pivoting structure of each sliding rod has an internal thread structure, an outer surface of the fixing portion of each fastening shaft has an external thread structure, the external thread structures of the two fastening shafts are engaged with the internal thread structures of the two sliding rods for making the external thread structures of the two fastening shafts cooperated with and connected with the internal thread structures of the two sliding rods.

12. The headset as claimed in claim 8, wherein each fastening shaft defines a penetrating hole penetrating through middles of a top surface and a bottom surface of each fastening shaft, insides of the two pivoting structures of the two sliding rods are communicated with the two insertion holes through the two penetrating holes of the two fastening shafts.

13. The headset as claimed in claim 12, further comprising at least one cable passing through the two penetrating holes of the two fastening shafts, and the at least one cable being exposed out of the two insertion holes and being connected with the two earphone monomers.

14. The headset as claimed in claim 8, wherein the pivot block is shown as a ring shape.

15. The headset as claimed in claim 9, wherein a shore hardness of each elastic element is more than A50 and is less than A70.

16. The headset as claimed in claim 8, wherein the interfering portions of the two fastening shafts are interfered with the two pivot blocks of the two suspension brackets.

17. The headset as claimed in claim 8, wherein the pivoting structure of each sliding rod is shown as a hollow cylinder shape, the insertion hole of each suspension bracket is cylindrical and is matched with the pivoting structure of each sliding rod, the two limitation blocks of each sliding rod and the two limitation slots of each suspension bracket are arc shapes.

18. A headset, comprising:

a curved headband;

two sliding rods slidably disposed to distal ends of two opposite ends of the headband, a tail end of each sliding rod including a pivoting structure, each sliding rod having two limitation blocks protruded outward from an outer portion and an inner portion of an outer surface of a periphery of the pivoting structure of each sliding rod;

two suspension brackets rotatably fastened to the two pivoting structures of the two sliding rods, a middle of each suspension bracket having an insertion hole which penetrates through each suspension bracket along an up-down direction, the insertion hole of each suspension bracket connected with one pivoting structure, the insertion hole of each suspension bracket having an assembling end receiving the one pivoting structure, a buffering end opposite to the assembling end, and a pivot block protruded inward from a middle of an inner wall of the insertion hole of each suspension bracket, the pivot block being located between the assembling end and the buffering end, two sides of an inner wall of the assembling end of the insertion hole of each suspension bracket being recessed oppositely to form two limitation slots, the two limitation blocks of each sliding rod being slidably limited in the two limitation slots of one suspension bracket for limiting a rotating angle of each suspension bracket around the one sliding rod, so that when each suspension bracket rotates around the pivoting structure of the one sliding rod, each suspension bracket being stopped rotating until end walls of the two limitation slots of each suspension bracket block the two limitation blocks of the one sliding rod;

two fastening shafts mounted in the two insertion holes of the two suspension brackets and fastened to the two pivoting structures of the two sliding rods, each fastening shaft having a fixing portion arranged to be assembled with the pivoting structure of the one sliding rod, an extending portion protruded upward from a middle of a top of the fixing portion, and an interfering portion disposed on an outer surface of each fastening shaft, and arranged between the fixing portion and the extending portion, the interfering portions of the two fastening shafts being interfered with the two pivot blocks of the two suspension brackets;

two elastic elements tightly disposed between the two extending portions of the two fastening shafts and the two buffering ends of the two suspension brackets; and two earphone monomers assembled to the two suspension brackets.

19. The headset as claimed in claim 18, wherein at least two portions of two outer periphery surfaces of the two extending portions of the two fastening shafts are recessed inward to form at least two restricting slots, the two elastic elements are abrasion resistant rubbers and are molded into and fastened in the at least two restricting slots of the two fastening shafts by an injection molding technology.

20. The headset as claimed in claim 18, wherein the extending portion of each fastening shaft has two restricting slots, the two restricting slots are symmetrically formed at an outer periphery surface of the extending portion of each fastening shaft.

* * * * *